US006784386B2

(12) United States Patent
Chou et al.

(10) Patent No.: US 6,784,386 B2
(45) Date of Patent: Aug. 31, 2004

(54) VIBRATION SWITCH WITH AXIALLY EXTENDING DEFLECTABLE ELECTRIC CONTACT

(75) Inventors: Tien-Ming Chou, No. 41, San-Hsi 5th Street, Pei District, Taichung City (TW); Kun-Chih Chou, Tai-Ping (TW)

(73) Assignee: Tien-Ming Chou, Taichung (TW)

( * ) Notice: Subject to any disclaimer, the term of this patent is extended or adjusted under 35 U.S.C. 154(b) by 0 days.

(21) Appl. No.: 10/715,372

(22) Filed: Nov. 19, 2003

(65) Prior Publication Data

US 2004/0144631 A1 Jul. 29, 2004

(51) Int. Cl.[7] ..... H01H 35/02
(52) U.S. Cl. ..... 200/61.51; 200/61.48
(58) Field of Search ..... 200/61.51, 61.5, 200/61.52, 61.53, 61.48, 61.49

(56) References Cited

U.S. PATENT DOCUMENTS 3,631,804 A * 1/1972 Anderson et al. ..... 102/273
3,649,787 A * 3/1972 Kasabian ..... 200/61.45 R
3,731,022 A * 5/1973 Loftus ..... 200/61.49
3,740,503 A * 6/1973 Tomohiro et al. ..... 200/61.47
3,781,496 A * 12/1973 Jones, Sr. ..... 200/61.45 R
3,899,649 A * 8/1975 Jenkins ..... 200/61.51
4,201,898 A * 5/1980 Jones et al. ..... 200/61.45 R
4,789,762 A * 12/1988 Miller et al. ..... 200/61.45 R
5,354,958 A * 10/1994 Bitko ..... 200/61.45 R
5,786,553 A * 7/1998 Zakutin ..... 200/61.48
5,789,716 A * 8/1998 Wang ..... 200/61.45 R
5,880,351 A * 3/1999 Orita et al. ..... 73/1.82
5,955,712 A * 9/1999 Zakutin ..... 200/61.48
6,545,235 B1 4/2003 Chou

* cited by examiner

*Primary Examiner*—Lincoln Donovan
*Assistant Examiner*—K. Lee
(74) *Attorney, Agent, or Firm*—Foley & Lardner

(57) ABSTRACT

A vibration switch includes a housing with two side walls and a surrounding wall interposed therebetween to confine an accommodation chamber, two electric contact terminals respectively having contact ends extending in the chamber and electrically insulated and spaced apart from each other, and a deflectable electric contact body disposed in the chamber. The contact body has two anchoring ends anchoring on the side walls, respectively, and an intermediate portion which is deflectable so as to be disposed in electric contact with at least one of the contact ends for establishing an electrical connection between the terminals.

12 Claims, 18 Drawing Sheets

VIBRATION SWITCH WITH AXIALLY EXTENDING DEFLECTABLE ELECTRIC CONTACT

BACKGROUND OF THE INVENTION

1. Field of the Invention

This invention relates to a vibration switch, more particularly to a vibration switch with an axially extending deflectable electric contact body which has two ends anchoring on two side walls of a housing and an intermediate portion that is deflectable so as to make an electrical connection between two electric contact terminals.

2. Description of the Related Art

FIGS. 1 to 3 show a vibration switch 1, which is disclosed in U.S. Pat. No. 6,545,235 B1 granted to the applicant of the present invention. The vibration switch 1 includes an electrically conductive housing 11, a coil spring 12, and first and second electric contact terminals 114,14. The housing 11 defines an accommodation chamber 112 therein. The first electric contact terminal 114 extends downwardly from a side wall 1122 of the housing 11. The second electric contact terminal 14 passes through an insulating plug member 13 fitted in an open end 1121 of the housing 11 so as to extend into the accommodation chamber 112. The coil spring 12 has an anchoring end 121 which anchors on a stem portion 113 secured on the side wall 1122, and a deflectable segment 123 which extends from the anchoring end 121 towards the second electric contact terminal 14 to terminate at a contact terminal end 122. By virtue of the biasing force of the deflectable segment 123 that acts against the weight thereof, the contact terminal end 122 is held in such a manner as to surround the second electric contact terminal 14. As shown in FIG. 3, once the housing 11 is jerked by means of a force (F), the contact terminal end 122 is deflected radially as a result of an inertial force of the deflectable segment 123 so as to contact the second electric contact terminal 14, thereby making an electrical connection between the first and second electrical contact terminals 114,14. The vibration switch 1 can provide a stable electrical connection between the electric contact terminals 14,114. However, since only the anchoring end 121 of the coil spring 12 is secured relative to the housing 11, the contact terminal end 122 tends to droop, and may undesirably contact the second electric contact terminal 14, thereby resulting in a contact error.

SUMMARY OF THE INVENTION

The object of the present invention is to provide a vibration switch in which a deflectable electric contact body can be supported firmly so as to minimize undesired contact of the contact body with an electric contact terminal.

According to this invention, the vibration switch includes a housing, first and second electric contact terminals, and a deflectable electric contact body.

The housing is adapted to be mounted on a support in an upright direction, and has first and second side walls spaced apart from each other along an axis in a longitudinal direction transverse to the upright direction, and a surrounding wall interposed between and cooperating with the first and second side walls to confine an accommodation chamber thereamong.

The first electric contact terminal has a first connecting end which is adapted to be connected to the support, and a first contact end which extends from the first connecting end to confront the accommodation chamber.

The second electric contact terminal is disposed to be electrically insulated from the first electric contact terminal, and has a second connecting end which is adapted to be connected to the support, and a second contact end which extends from the second connecting end into the accommodation chamber proximate to the second side wall. When the vibration switch is in a stable position, the second contact end is electrically insulated. The second contact end is spaced apart from the first contact end within the accommodation chamber.

The deflectable electric contact body is disposed in the accommodation chamber, and has first and second anchoring ends which are opposite to each other in the longitudinal direction and which are disposed to anchor on the first and second side walls, respectively, and an intermediate portion which is interposed between the first and second anchoring ends. The intermediate portion is made from a deflectable material, and includes a deflecting segment, and first and second deflected segments that flank the deflecting segment and that are respectively proximate to the first and second anchoring ends so as to be deflected with the deflecting segment in the same direction. The deflecting segment is configured in such a manner as to acquire a biasing force such that, by virtue of the biasing force that acts against weight of the deflecting segment, the first and second contact ends are held in the stable position, and such that, when the housing is jerked out of the stable position, the deflecting segment, together with the first and second deflected segments, is deflected in a direction radial to the axis as a result of an inertial force thereof, thereby bringing at least one of the deflecting segment and the first and second deflected segments into electric contact with at least one of the first and second contact ends.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
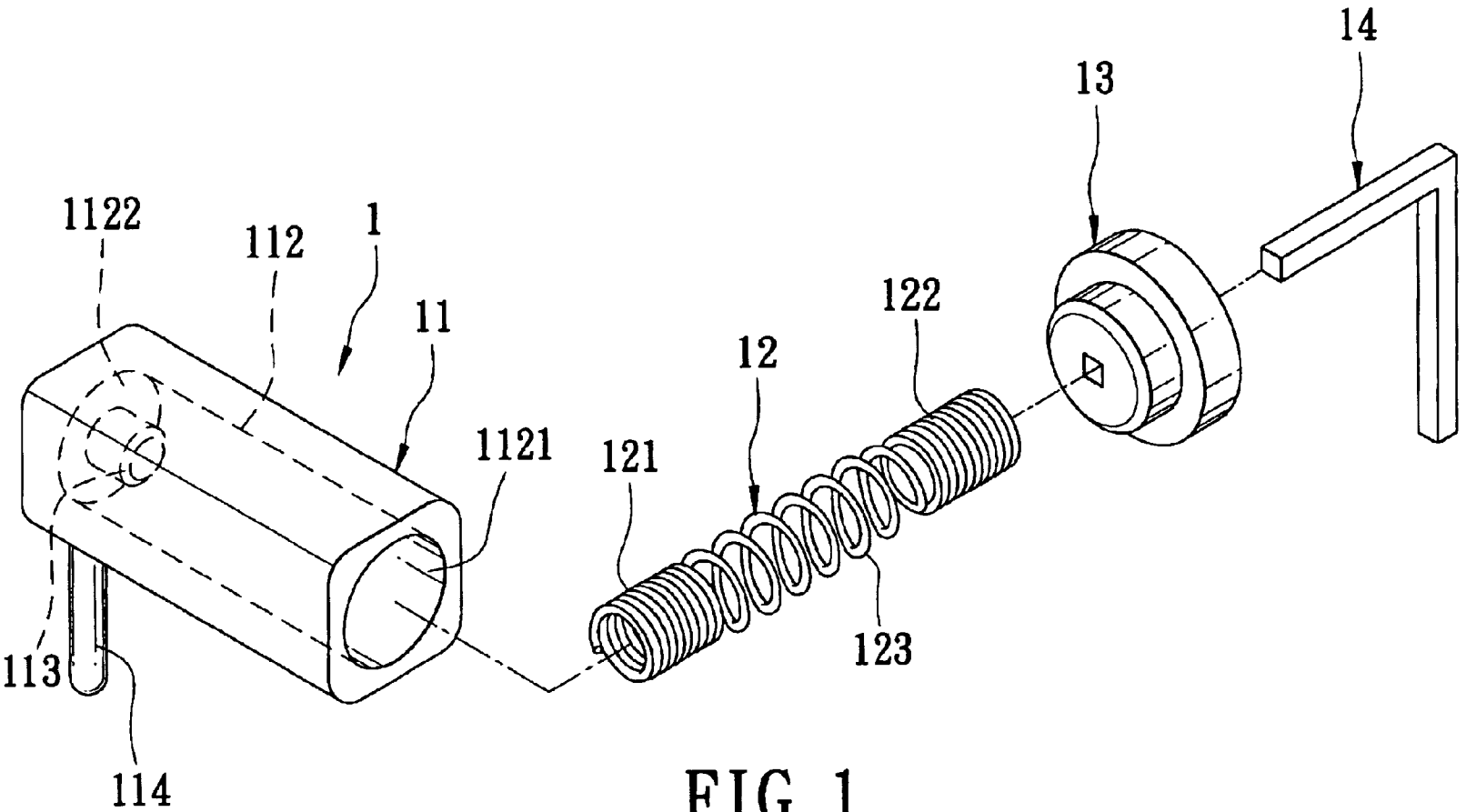
FIG. 1 PRIOR ART
FIG. 1 is an exploded perspective view of a conventional vibration switch.
Figure 2:
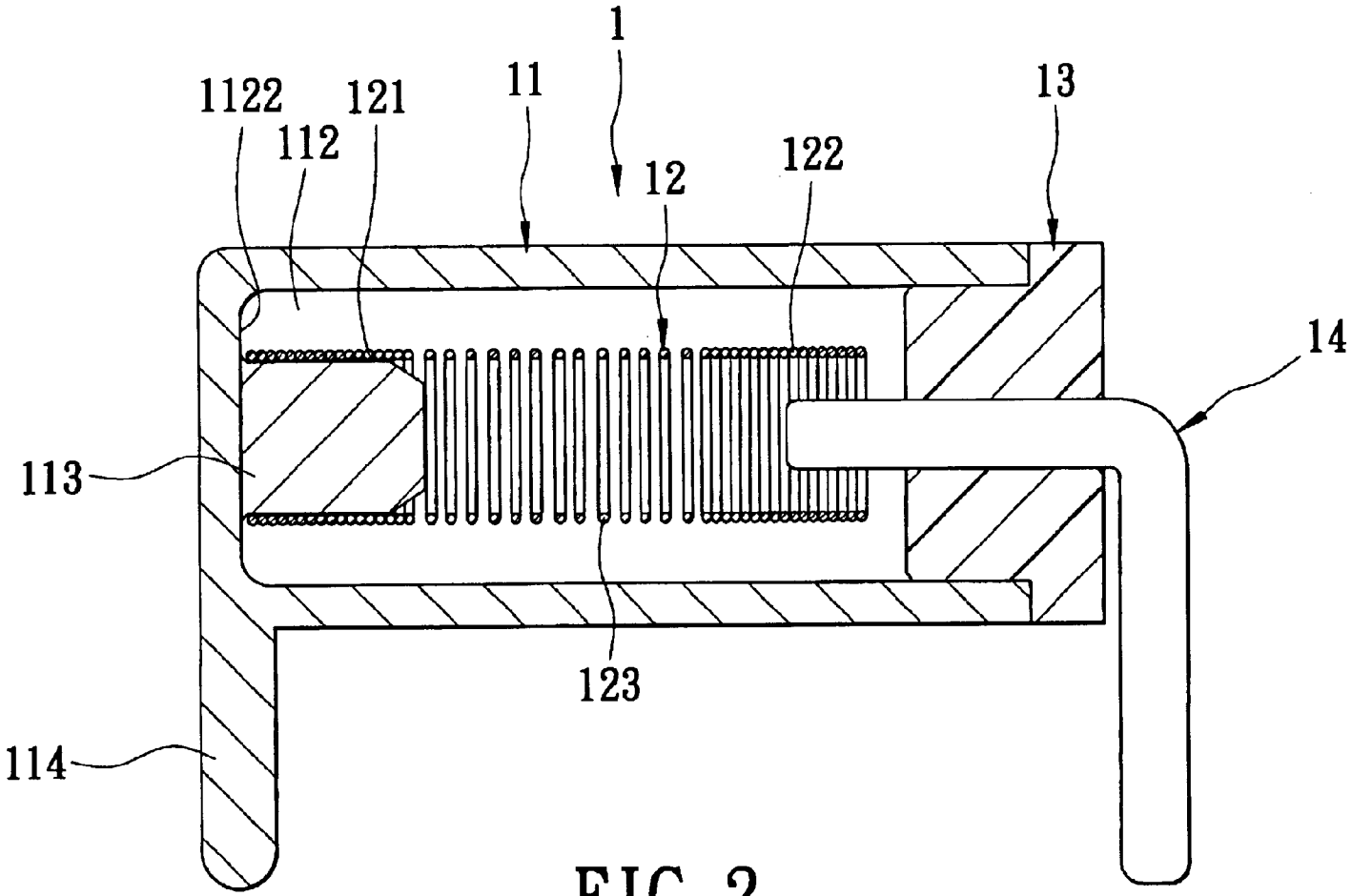
FIG. 2 PRIOR ART
FIGS. 2 and 3 are sectional view of the conventional vibration switch in switch-off and switch-on states, respectively.
Figure 3:
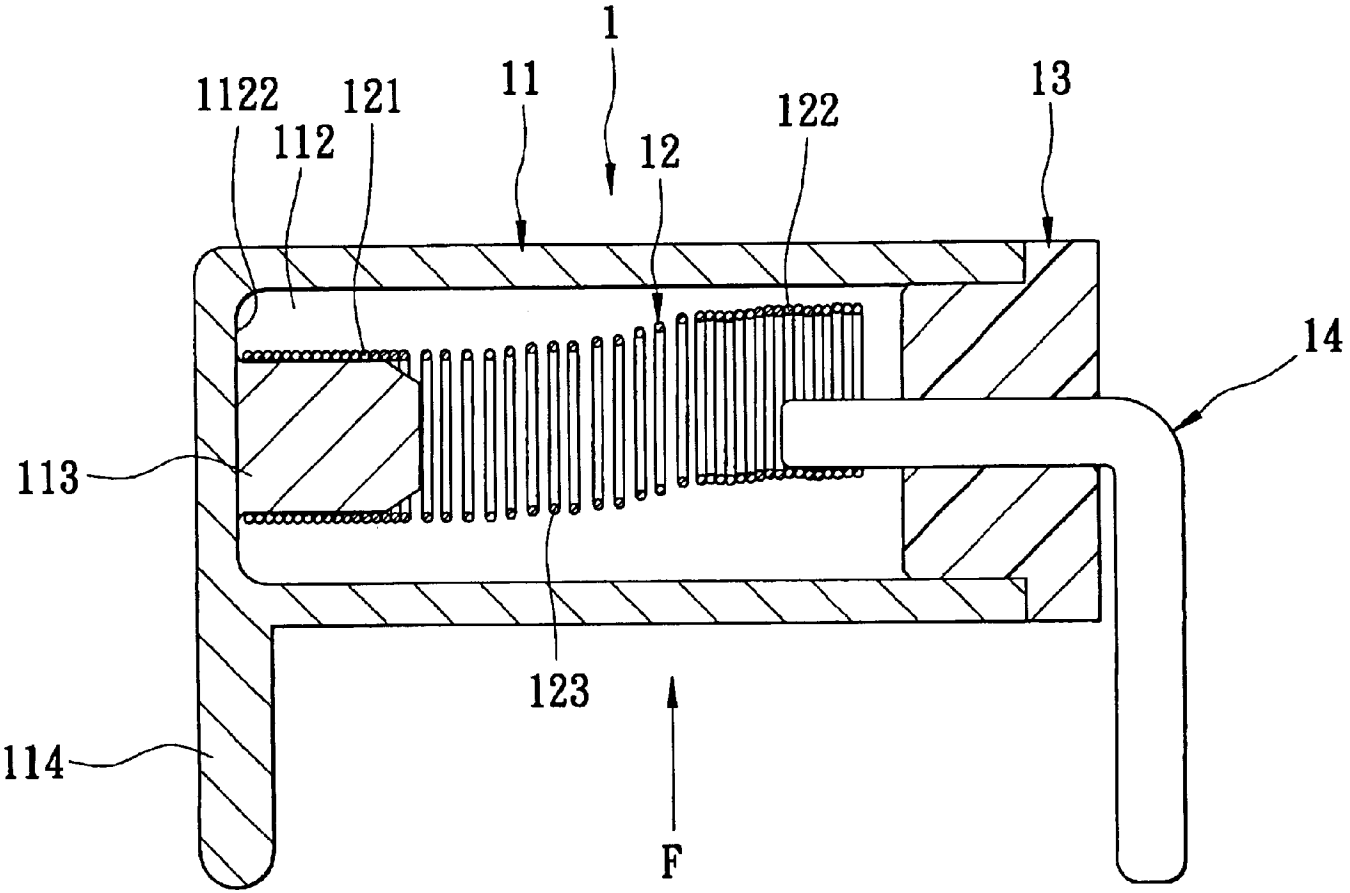
FIG. 3 PRIOR ART
Figure 4:
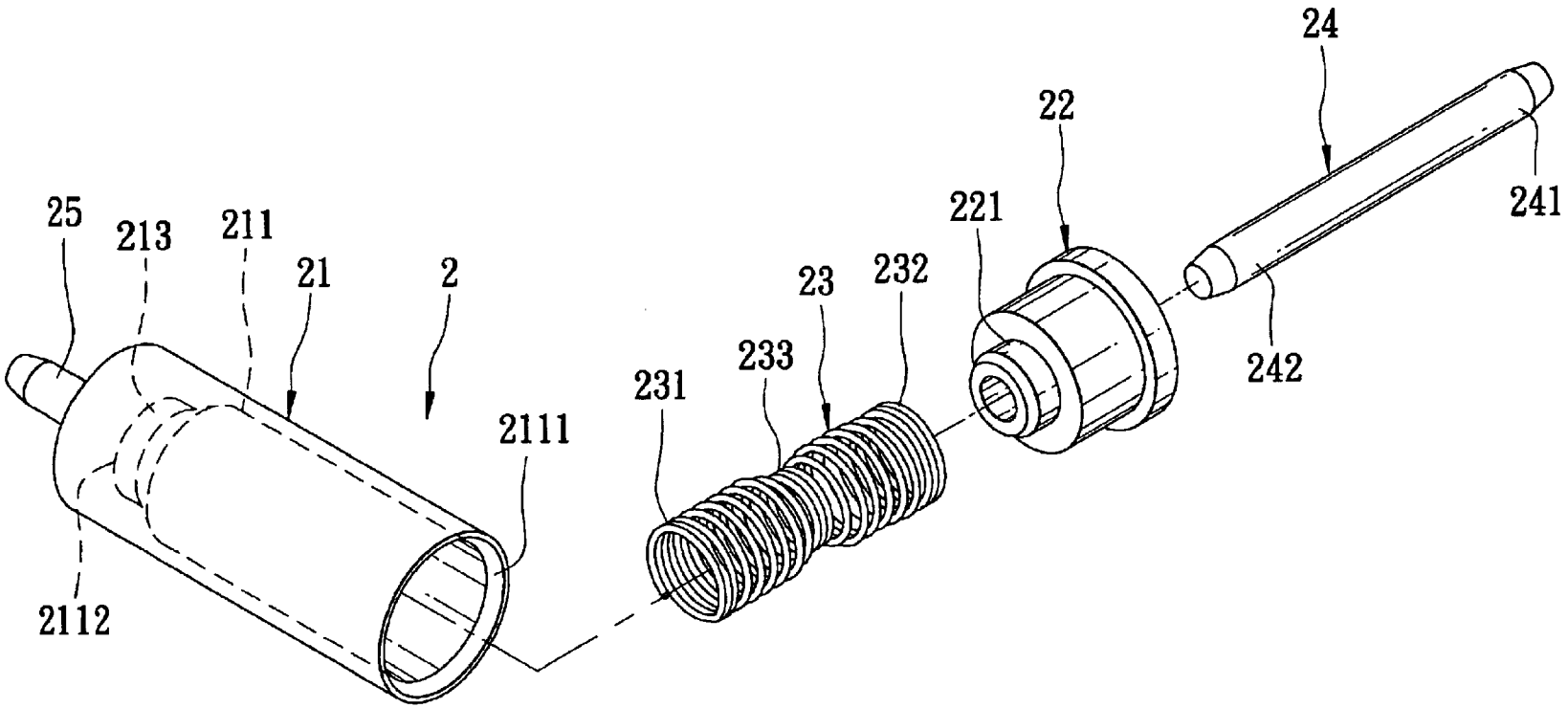
FIG. 4 is an exploded perspective view of the first preferred embodiment of a vibration switch according to this invention.
Figure 5:
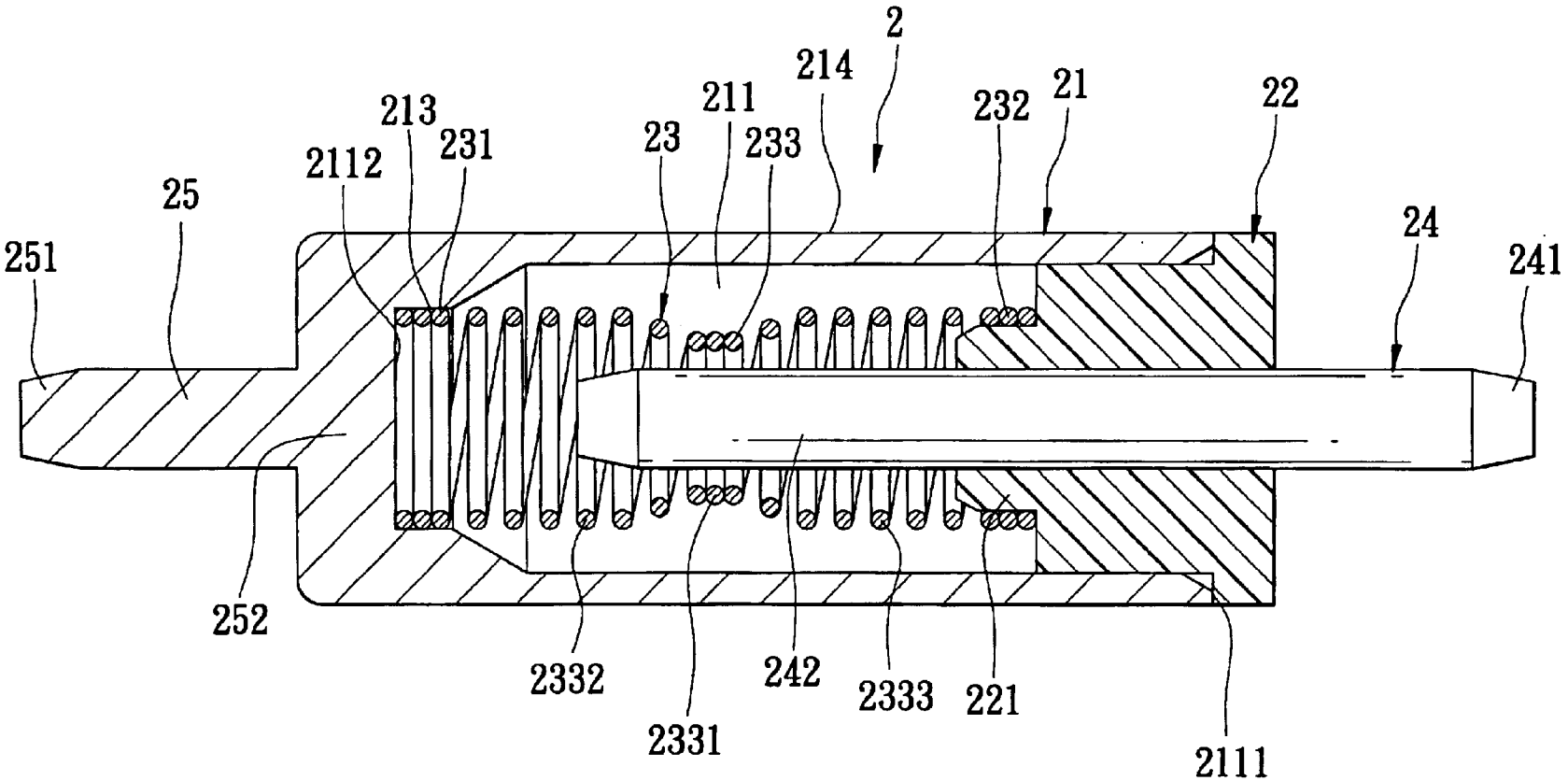
FIGS. 5 and 6 are sectional views of the first preferred embodiment in switch-off and switch-on states, respectively.
Figure 6:
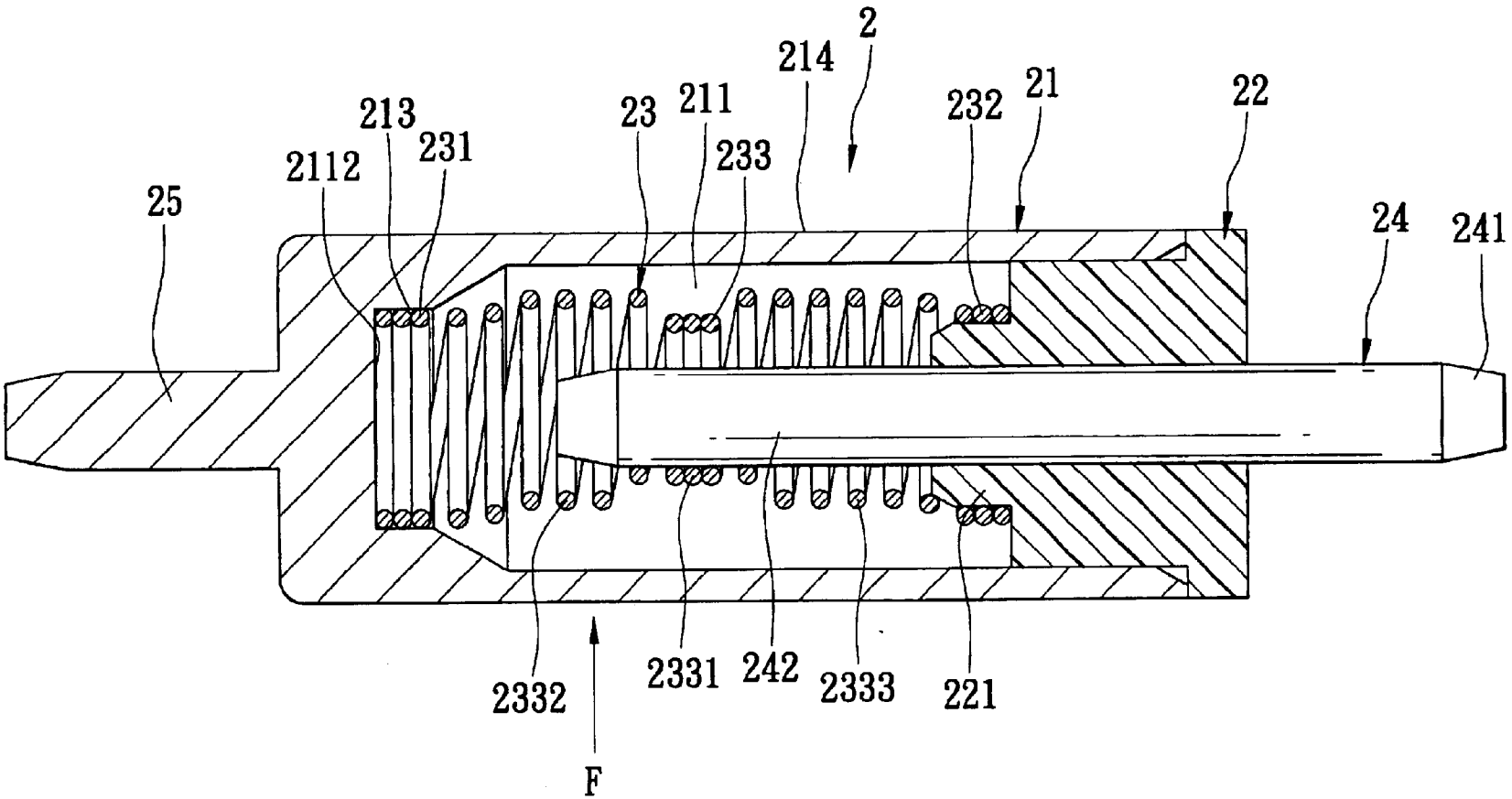

Referring to FIGS. 4, 5 and 6, the first preferred embodiment of a vibration switch 2 according to the present invention is shown to comprise a housing 21, a plug member 22, first and second electric contact terminals 25,24, and a biasing deflectable electric contact body 23.

The housing 21 is adapted to be mounted on a support (not shown) in an upright direction, and has a first side wall 2112 and a surrounding wall 214 which extends from the first side wall 2112 in a longitudinal direction transverse to the upright direction. The first side wall 2112 and the surrounding wall 214 cooperatively confine an accommodation chamber 211 with an opening end 2111 opposite to the first side wall 2112, and are made from an electrically conductive metal material. The plug member 22 is made from an insulating material, and is fittingly inserted into the opening end 2111 to serve as a second side wall of the housing 21, which is spaced apart from the first side wall 2112 along an axis in the longitudinal direction. The plug member 22 is provided with an anchored protrusion 221 extending along the axis. The first side wall 2112 has an anchored recess 213 formed therein and confronting the anchored protrusion 221.

The first electric contact terminal 25 is formed integrally with the first side wall 2112. The first electric contact terminal 25 has a first connecting end 251 which projects outward from the first side wall 2112 and which is adapted to be connected to the support, and a first contact end 252 which extends from the first connecting end 251 to confront the accommodation chamber 211.

The second electric contact terminal 24 has a second connecting end 241 which is adapted to be connected to the support, and a second contact end 242 which extends from the second connecting end 241 through the plug member 22 along the axis into the accommodation chamber 211 so as to be spaced apart from the first contact end 252 of the first electric contact terminal 25 within the accommodation chamber 211. As such, when the vibration switch 2 is in a stable position as shown in FIG. 5, the second contact end 242 is electrically insulated from the first electric contact terminal 25.

The deflectable electric contact body 23, such as a coil spring made from an electrically conductive material, is disposed in the accommodation chamber 211. The coil spring 23 includes a plurality of loops wound spirally about the axis. The coil spring 23 has a first anchoring end 231 which is retained in the anchored recess 213, a second anchoring end 232 which is opposite to the first anchoring end 231 in the longitudinal direction and which is retained on the anchored protrusion 221, and an intermediate portion 233 which is interposed between the first and second anchoring ends 231,232 and which is disposed to surround the second contact end 242 of the second electric contact terminal 24. As such, the first anchoring end 231 is electrically connected to the first contact end 252 of the first electric contact terminal 25.

The intermediate portion 233 includes a deflecting segment 2331, and first and second deflected segments 2332, 2333 that flank the deflecting segment 2331 and that are respectively proximate to the first and second anchoring ends 231,232 so as to be deflected with the deflecting segment 2331 in the same direction. Preferably, a first distance defined between two adjacent ones of the loops at each of the first and second deflected segments 2332,2333 along the axis is larger than a second distance defined between two adjacent ones of the loops at the deflecting segment 2331 along the axis. In addition, the loops at the deflecting segment 2331 have an inner diameter which is smaller than that of the loops at the first and second deflected segments 2332,2333. The deflecting segment 2331 is configured in such a manner as to acquire a biasing force such that, by means of the biasing force that acts against weight of the deflecting segment 2331, the first and second contact ends 252,242 are held in the stable position. Referring to FIG. 6, when the housing 21 is jerked out of the stable position by a force (F), the deflecting segment 2331, together with the first and second deflected segments 2332, 2333, is deflected in a direction radial to the axis as a result of an inertial force thereof, thereby bringing at least one of the deflecting segment 2331 and the first and second deflected segments 2332,2333 into electric contact with the second contact end 242, thereby making an electrical connection between the first and second electric contact terminals 25,24.

Figure 7:
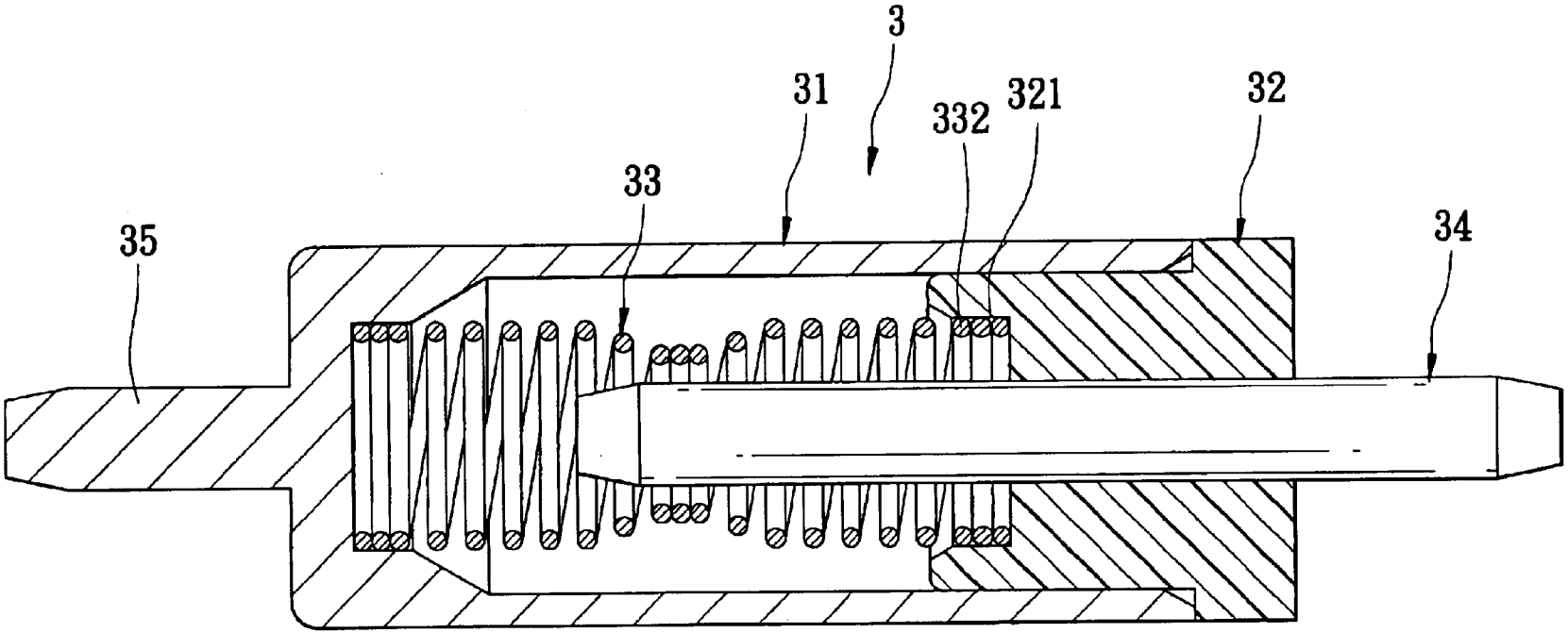
FIGS. 7 and 8 are sectional views of the second preferred embodiment of a vibration switch according to this invention in switch-off and switch-on states, respectively.
Figure 8:
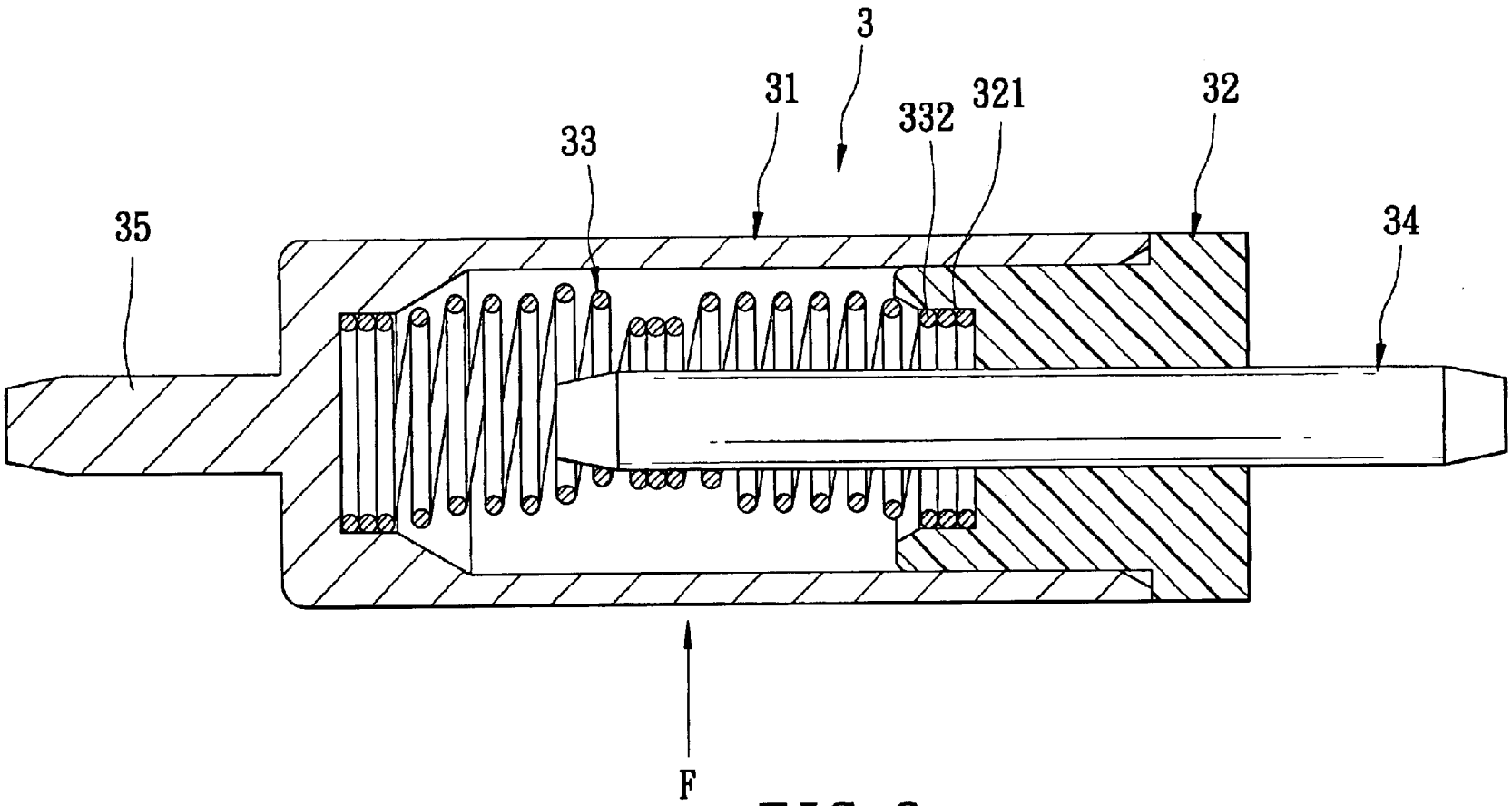

Referring to FIGS. 7 and 8, the second preferred embodiment of a vibration switch 3 according to this invention is shown to be similar to the first embodiment in construction, and includes a housing 31, a plug member 32, first and second electric contact terminals 35,34, and a coil spring 33. In this embodiment, instead of the anchored protrusion, an anchored recess 321 is formed in the plug member 32 for retaining the second anchoring end 332 of the coil spring 33. Since the operation of the vibration switch 3 is similar to that of the first preferred embodiment, a description thereof is omitted herein for the sake of brevity.

Figure 9:
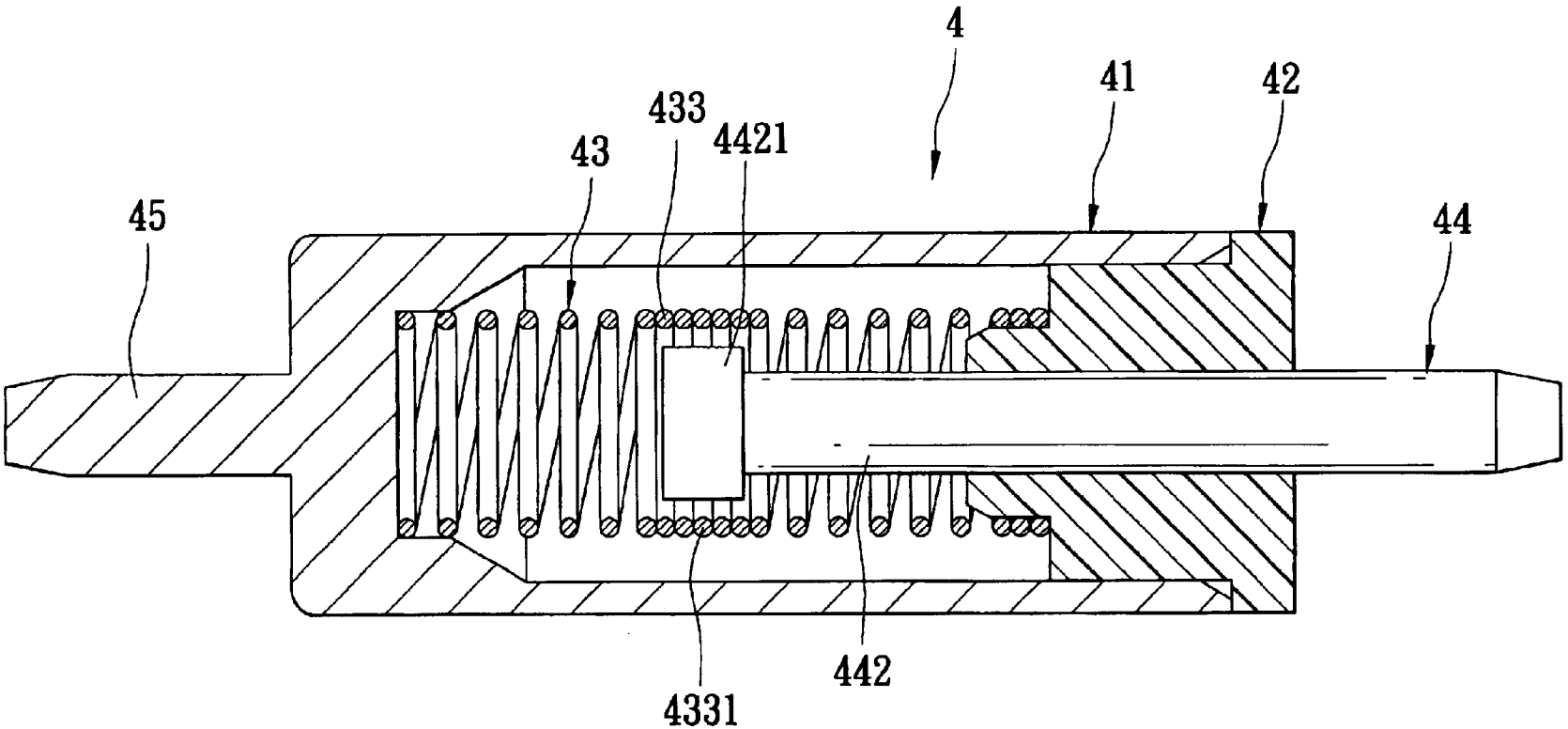
FIGS. 9 and 10 are sectional views of the third preferred embodiment of a vibration switch according to this invention in switch-off and switch-on states, respectively.
Figure 10:
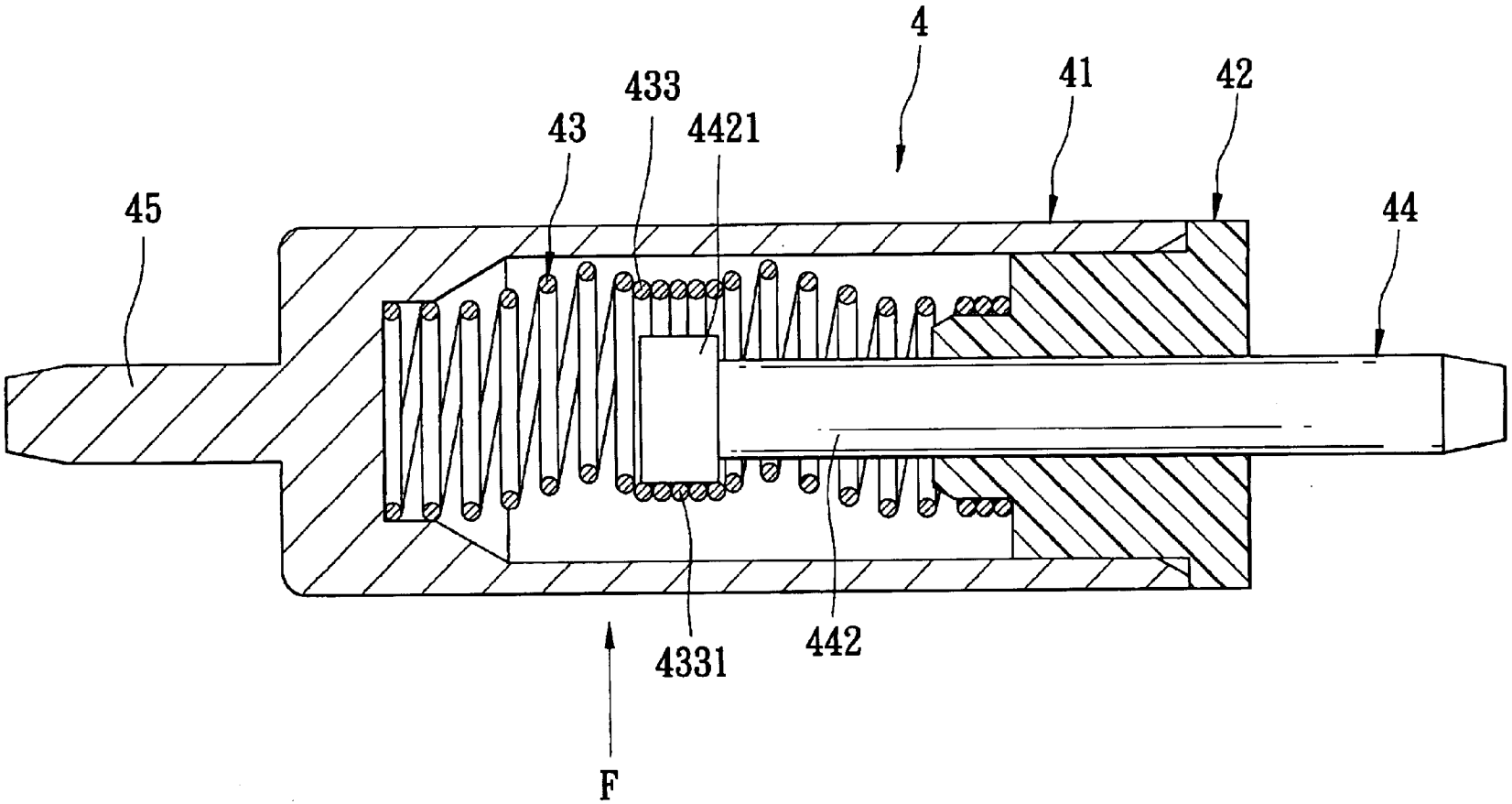

Referring to FIGS. 9 and 10, the third preferred embodiment of a vibration switch 4 according to this invention is shown to include a housing 41, a plug member 42 fitted into an opening end of the housing 41, a first electric contact terminal 45 extending from the housing 41 opposite to the plug member 42, a second electric contact terminal 44 extending through the plug member 42 and having a contact end 442 disposed in the housing 41, and a coil spring 43 having a plurality of loops with a uniform inner diameter. The contact end 442 has an enlarged contact head 4421 which is disposed within the loops at the deflecting segment 4331 of the intermediate portion 433 of the coil spring 43 so as to facilitate contact between the contact end 442 and the loops when the housing 41 is jerked out of the stable position.

Figure 11:
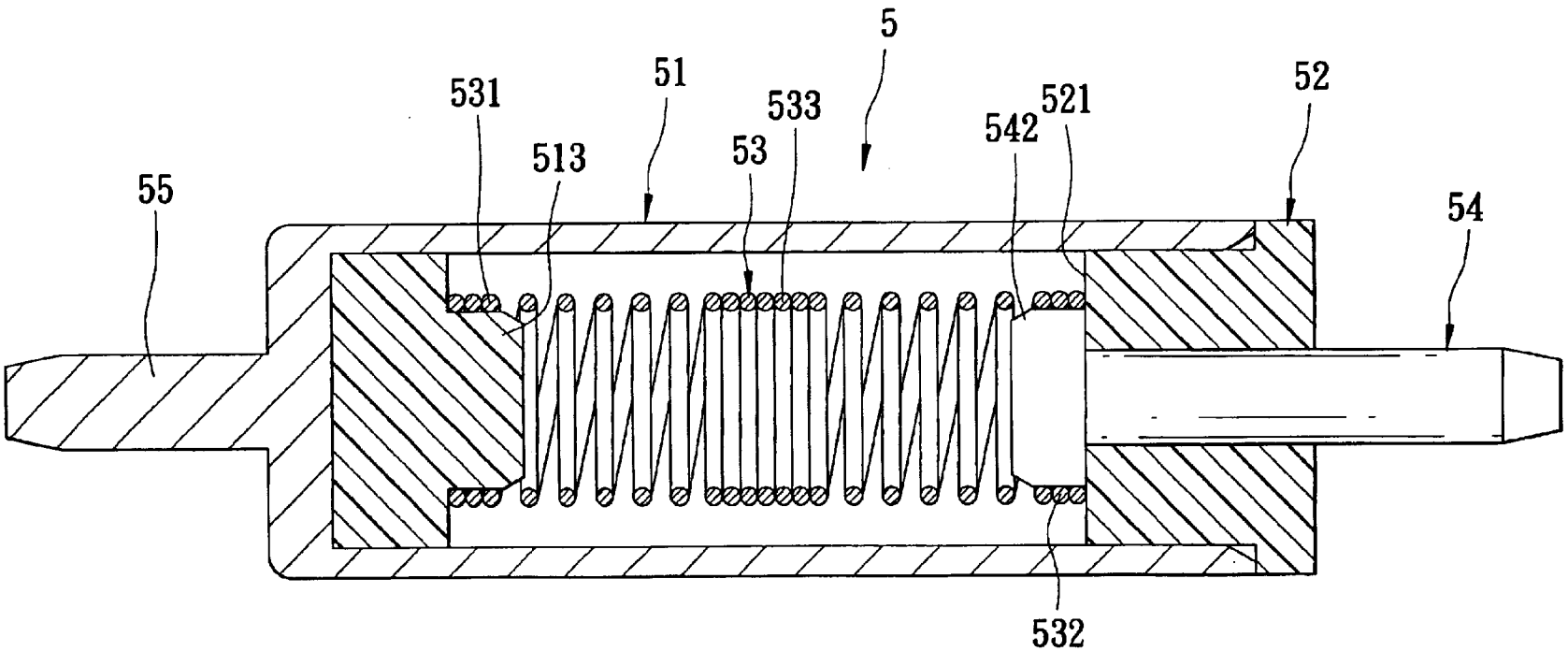
FIGS. 11 and 12 are sectional views of the fourth preferred embodiment of a vibration switch according to this invention in switch-off and switch-on states, respectively.
Figure 12:
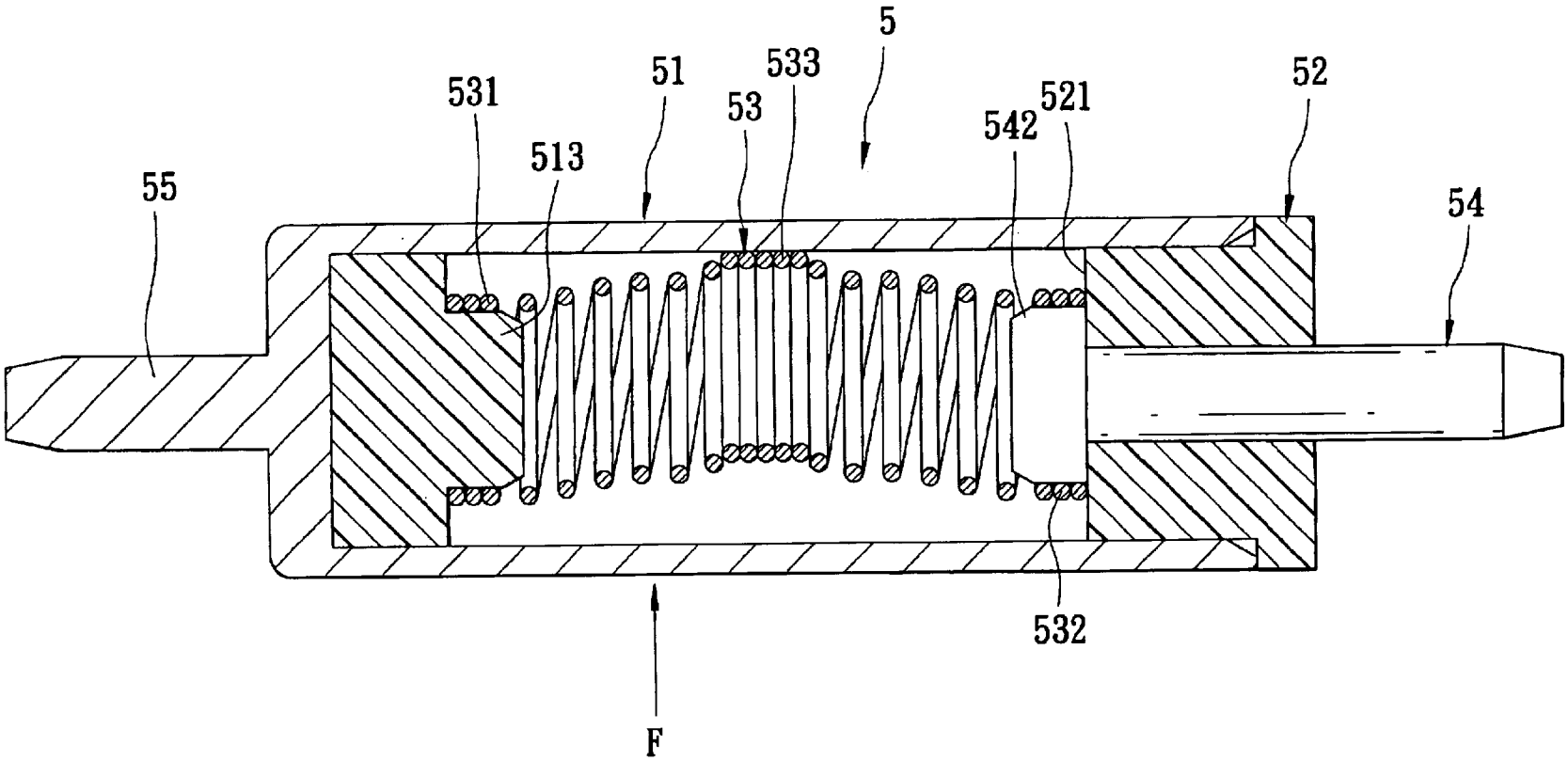

Referring to FIGS. 11 and 12, the fourth preferred embodiment of a vibration switch 5 according to this invention is shown to include a housing 51, a plug member 52, first and second electric contact terminals 55,54, and a coil spring 53. The first side wall of the housing 51 has an insulating protrusion 513 which extends towards the plug member 52 along the axis. The contact end 542 of the second electric contact terminal 54 has a block shape, and abuts against an inner side surface 521 of the plug member 52. The first and second anchoring ends 531,532 of the coil spring 53 are retainingly sleeved on the insulating protrusion 513 and the contact end 542, respectively, such that the second anchoring end 532 is electrically connected to the second electric contact terminal 54. As such, when a force (F) is applied to the housing 51, the intermediate portion 533 of the coil spring 53 can be deflected to come into electric contact with the contact end of the first electric contact terminal 55 so as to make an electrical connection between the first and second electric contact terminals 55,54.

Figure 13:
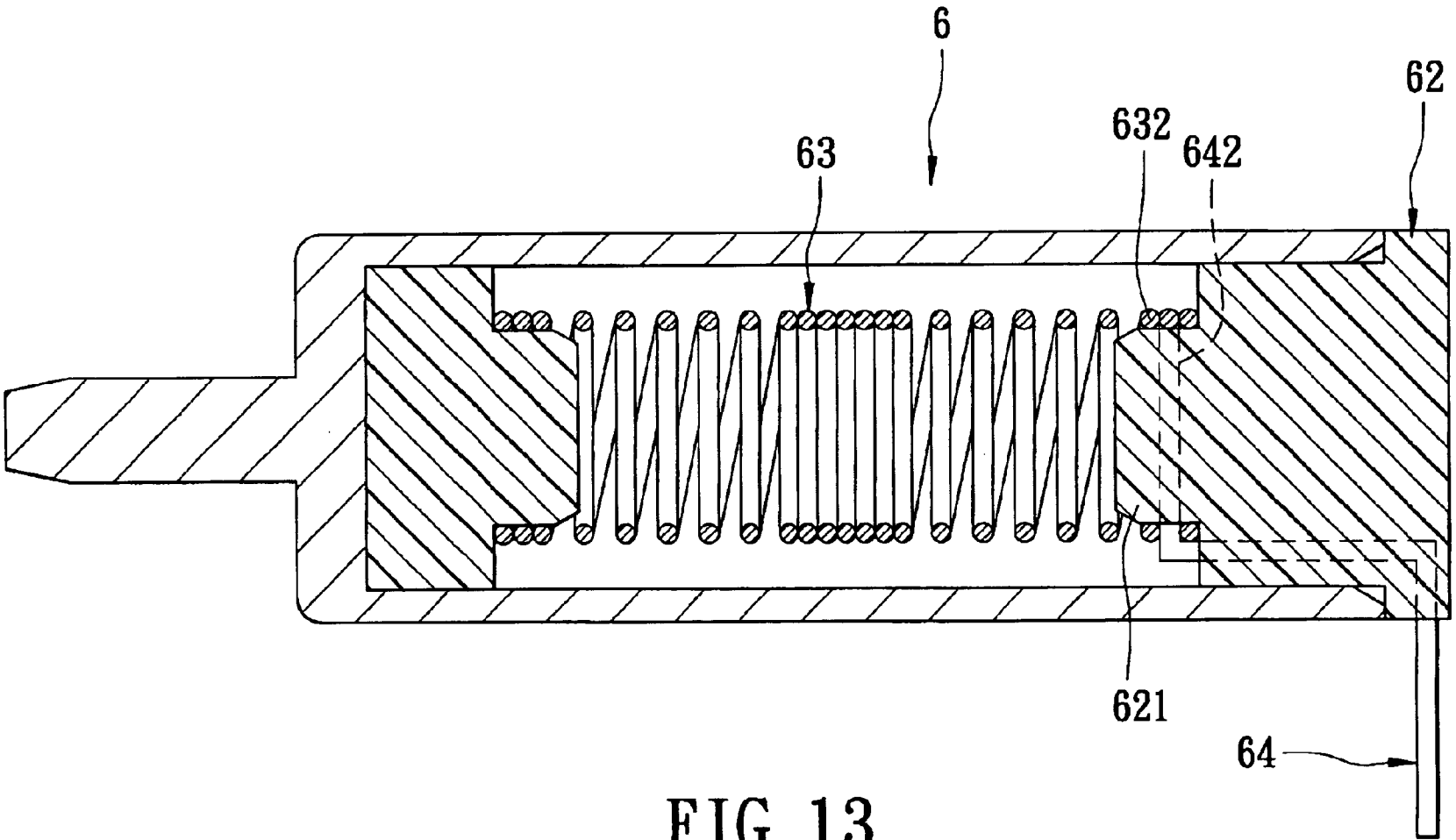
FIGS. 13 and 14 are sectional views of the fifth preferred embodiment of a vibration switch according to this invention in switch-off and switch-on states, respectively.
Figure 14:
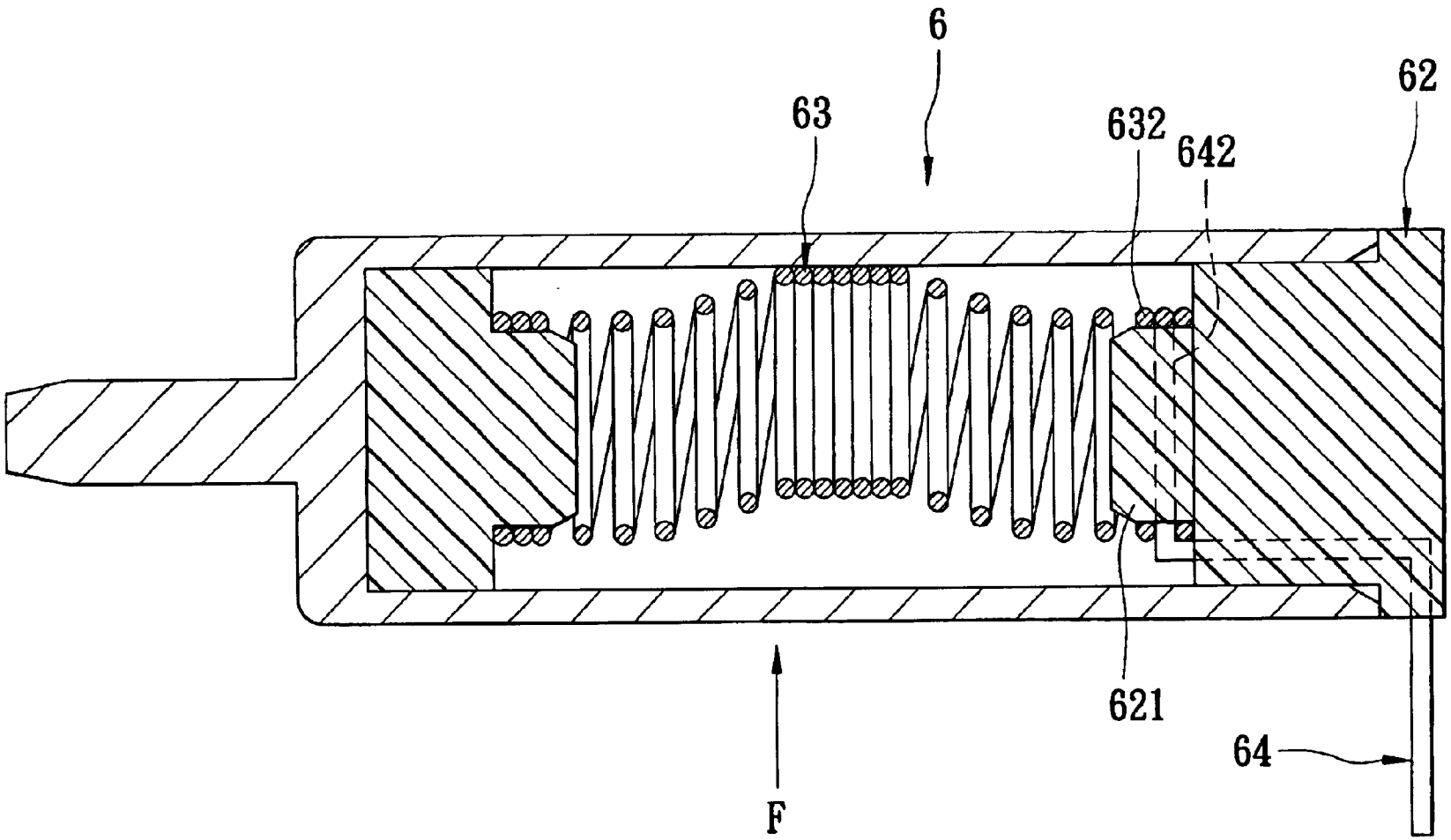

Referring to FIGS. 13 and 14, the fifth preferred embodiment of a vibration switch 6 according to this invention is shown to be similar to the fourth embodiment in construction, except that the second anchoring end 632 of the coil spring 63 is sleeved retainingly on the anchored protrusion 621 of the insulating plug member 62. The contact end 642 of the second electric contact terminal 64 extends through the anchored protrusion 621, and engages the second anchoring end 632 to make an electrical connection therebetween. Since the operation of the vibration switch 6 is similar to that of the fourth embodiment, a description thereof is omitted herein for the sake of brevity.

Figure 15:
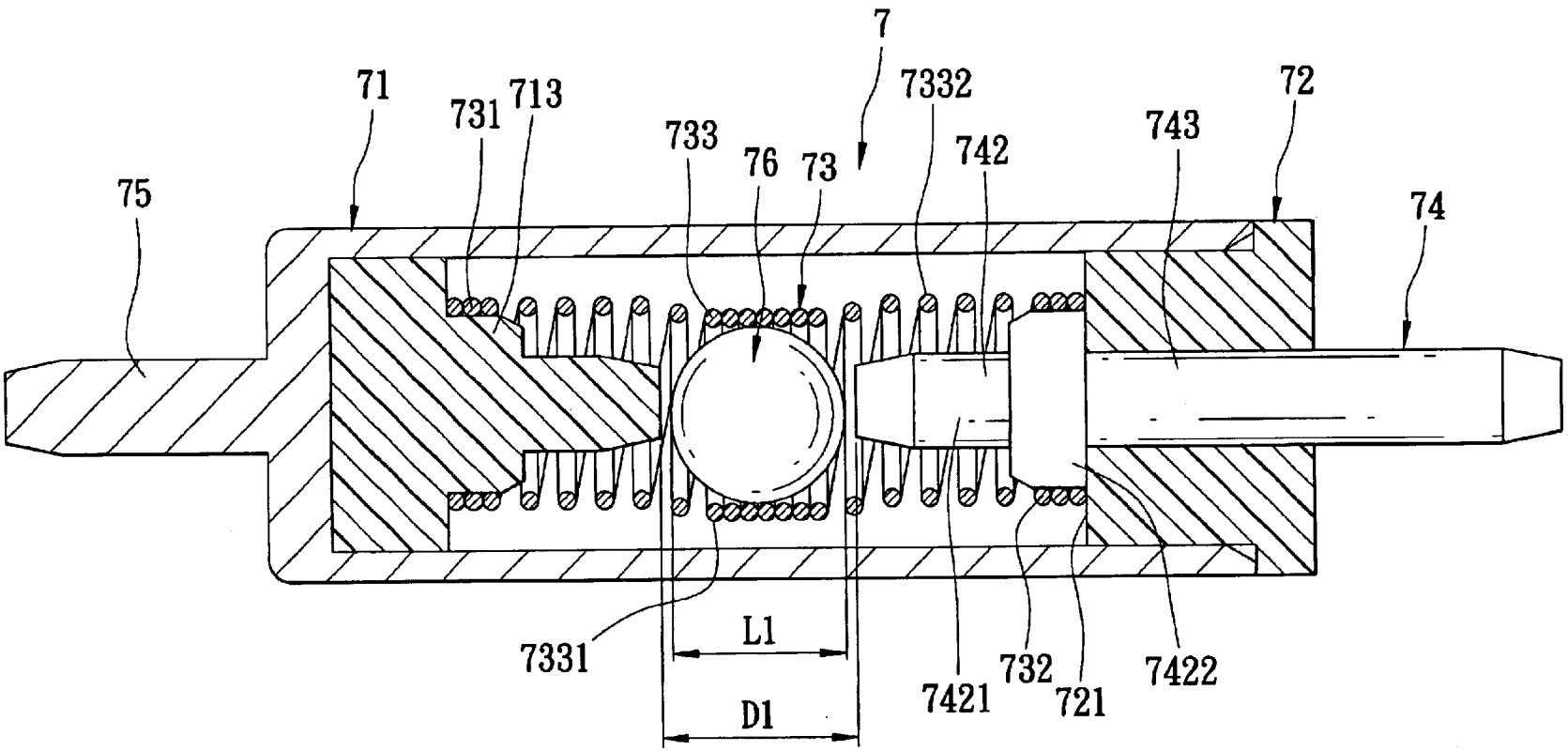
FIGS. 15 and 16 are sectional views of the sixth preferred embodiment of a vibration switch according to this invention in switch-off and switch-on states, respectively.
Figure 16:
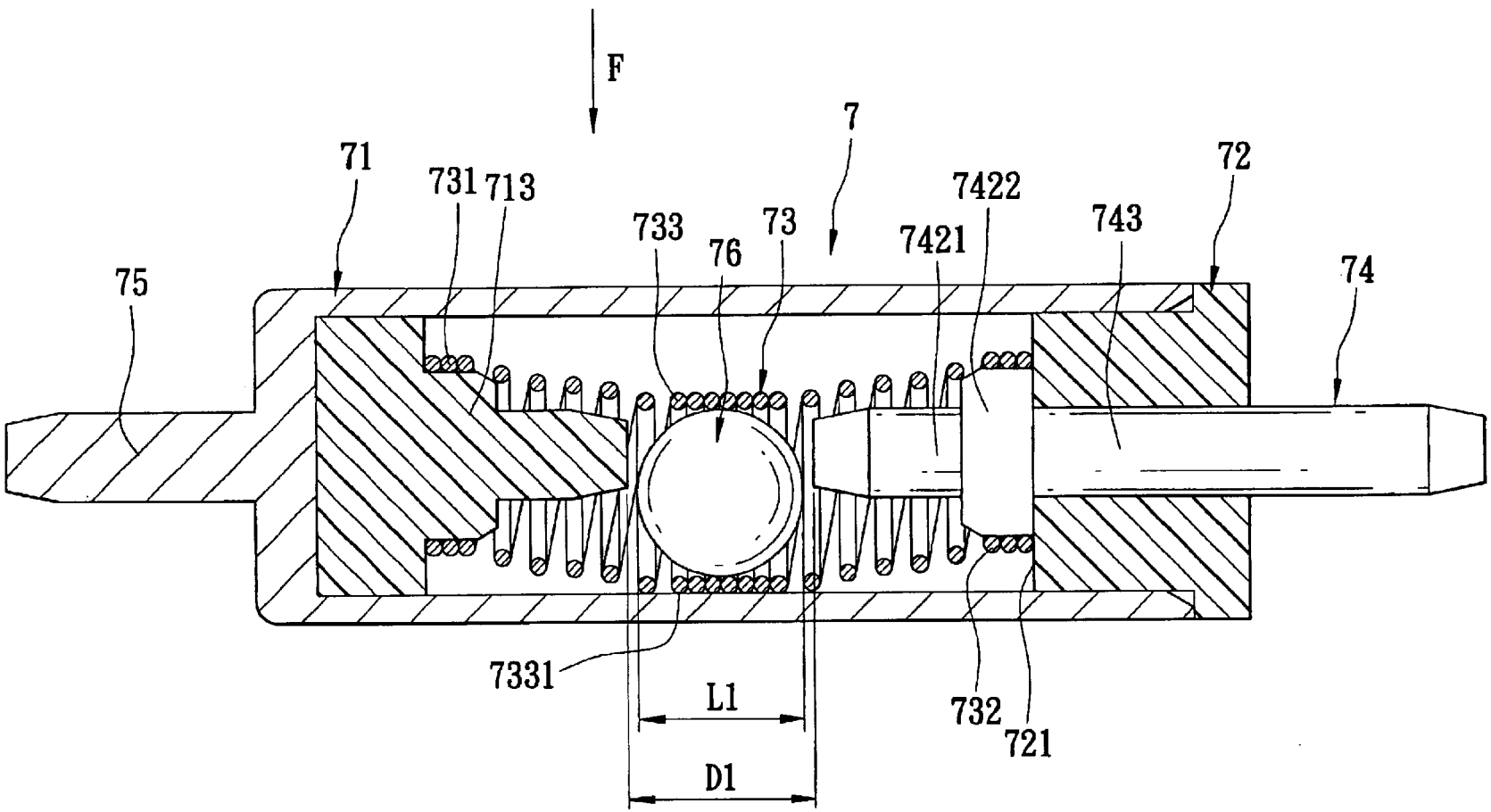

Referring to FIGS. 15 and 16, the sixth preferred embodiment of a vibration switch 7 according to this invention is shown to include a housing 71, a plug member 72, first and second electric contact terminals 75,74, and a coil spring 73 of a deflectable electric contact body. An insulating protrusion 713 extends towards the plug member 72 along the axis. The second electric contact terminal 74 includes a stem portion 743 which is inserted into and which is retained in the plug member 72. The contact end 742 of the second electric contact terminal 74 includes a block portion 7422 which extends from the stem portion 743 into the accommodation chamber of the housing 71 and which abuts against an inner side surface 721 of the plug member 72, and a rod portion 7421 which is disposed within the loops at the second deflected segment 7332 of the intermediate portion 733 of the coil spring 73. The first and second anchoring ends 731, 732 of the coil spring 73 are sleeved on the insulating protrusion 713 and the block portion 7422, respectively. The deflectable electric contact body further has a weight member 76 in form of a ball, which is rollably retained in the loops at the deflecting segment 7331, and which has a diameter (L1) that is smaller than the distance (D1) between the insulating protrusion 713 and the rod portion 7421. By means of the weight member 76, the weight of the deflecting segment 7331 can be increased so as to augment the inertial force of the deflecting segment 7331 when the housing 71 is jerked out of the stable position, thereby enhancing the sensitivity of the vibration switch 7.

Figure 17:
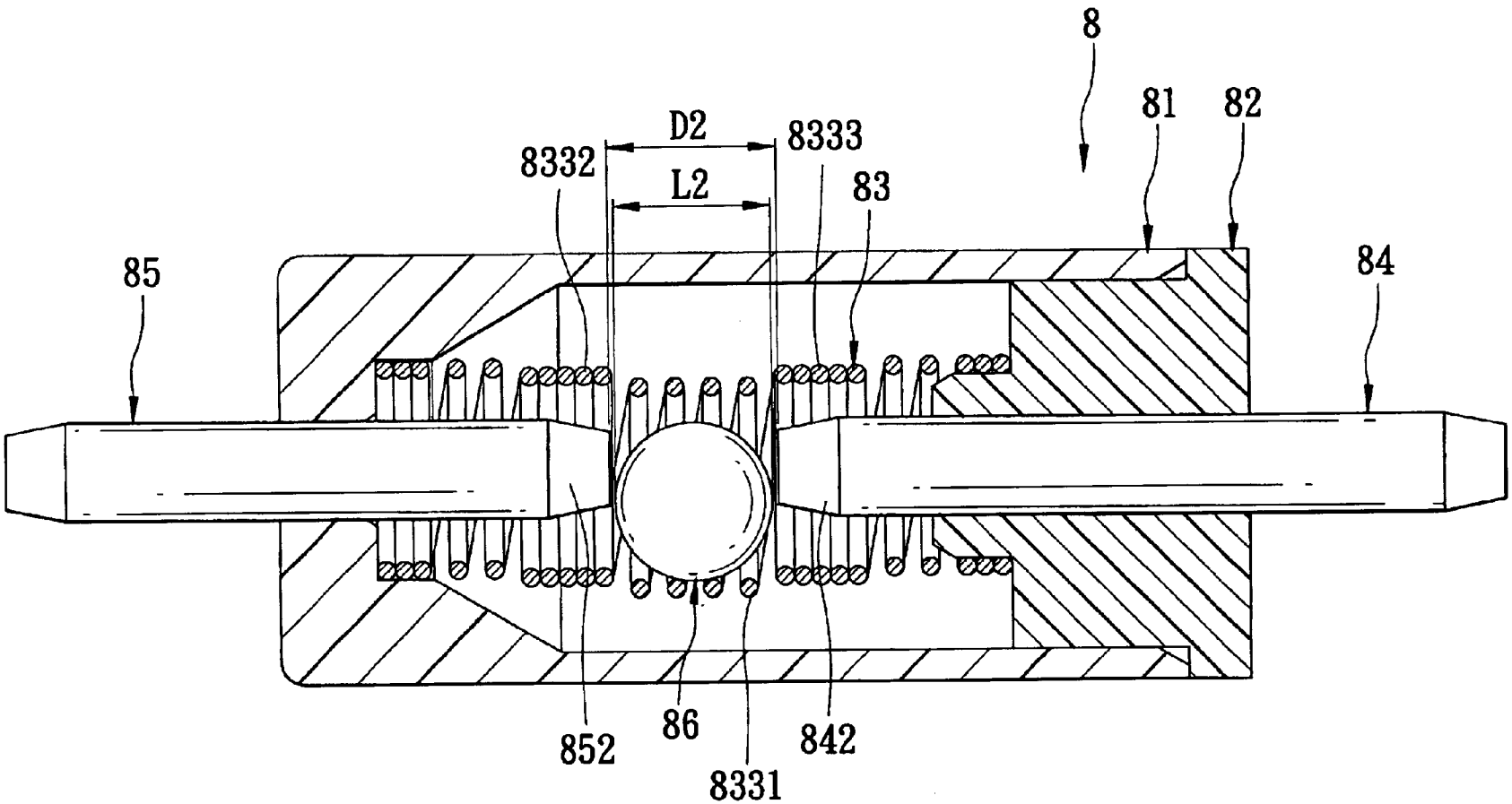
FIGS. 17 and 18 are sectional views of the seventh preferred embodiment of a vibration switch according to this invention in switch-off and switch-on states, respectively.
Figure 18:
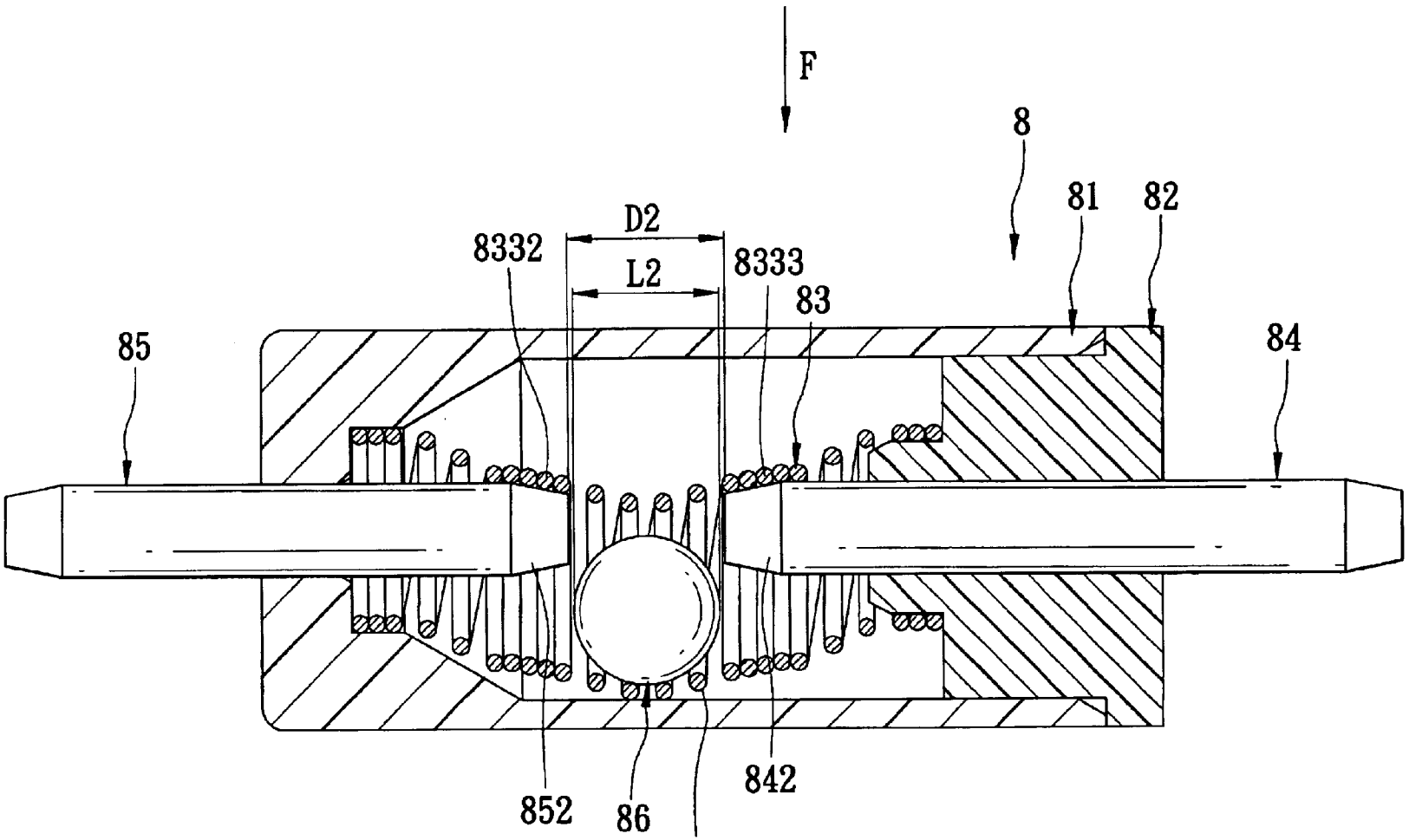

Referring to FIGS. 17 and 18, the seventh preferred embodiment of a vibration switch 8 according to this invention is shown to include a housing 81 made from an insulating material, an insulating plug member 82, rod-shaped first and second electric contact terminals 85,84, and a deflectable electric contact body including a coil spring 83 and a ball-shaped weight member 86. The first and second contact ends 852,842 are surrounded by the loops at the first and second deflected segments 8332,8333, respectively. The weight member 86 is rollably retained in the loops at the deflecting segment 8331, and has a diameter (L2) that is smaller than the distance (D2) between the first and second contact ends 852,842 such that the coil spring 83 is electrically insulated from both the first and second electric contact terminals 85,84. When a force (F) is applied to the housing 81, the first and second deflected segments 8332,8333 are brought into electric contact with the first and second contact ends 852,842, respectively, by the deflecting segment 8331 as a result of an inertial force of the deflecting segment 8331, thereby establishing an electrical connection between the first and second electric contact terminals 85,84. Also, the weight of the deflecting segment 8331 can be increased by means of the weight member 86 so as to increase the inertial force of the deflecting segment 8331.

As illustrated, since the deflectable electric contact body of the vibration switch according to this invention has two anchoring ends anchoring on the two side walls of the housing, better support for the deflectable electric contact body can be achieved to thereby minimize undesired contact of the deflectable electric contact body with an electric contact terminal when the housing is in a stable state.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A vibration switch comprising:

a housing adapted to be mounted on a support in an upright direction, and having first and second side walls which are spaced apart from each other along an axis in a longitudinal direction transverse to the upright direction, and a surrounding wall which is interposed between and which cooperates with said first and second side walls to confine an accommodation chamber thereamong;

a first electric contact terminal having a first connecting end which is adapted to be connected to the support, and a first contact end which extends from said first connecting end to confront said accommodation chamber;

a second electric contact terminal disposed to be electrically insulated from said first electric contact terminal, and having a second connecting end adapted to be connected to the support, and a second contact end extending from said second connecting end into said accommodation chamber proximate to said second side wall such that when said vibration switch is in a stable position, said second contact end is electrically insulated and is spaced apart from said first contact end within said accommodation chamber; and a deflectable electric contact body disposed in said accommodation chamber, and having first and second anchoring ends which are opposite to each other in the longitudinal direction and which are disposed to anchor on said first and second side walls, respectively, and an intermediate portion which is interposed between said first and second anchoring ends, said intermediate portion being made from a deflectable material, and including a deflecting segment, and first and second deflected segments that flank said deflecting segment and that are respectively proximate to said first and second anchoring ends so as to be deflected with said deflecting segment in a same direction, said deflecting segment being configured in such a manner as to acquire a biasing force such that, by virtue of the biasing force that acts against weight of said deflecting segment, said first and second contact ends are held in the stable position, and such that, when said housing is jerked out of the stable position, said deflecting segment, together with said first and second deflected segments, is deflected in a direction radial to the axis as a result of an inertial force thereof, thereby bringing at least one of said deflecting segment and said first and second deflected segments into electric contact with at least one of said first and second contact ends.

2. The vibration switch of claim 1, wherein said deflectable electric contact body includes a coil spring which is made from an electrically conductive material, and which includes a plurality of loops wound spirally about the axis.

3. The vibration switch of claim 2, wherein two adjacent ones of said loops at each of said first and second deflected segments defines a first distance along the axis, two adjacent ones of said loops at said deflecting segment defining a second distance along the axis, the second distance being smaller than the first distance.

4. The vibration switch of claim 3, wherein said first side wall and said surrounding wall of said housing are made from an electrically conductive material, said first electric contact terminal being formed integrally with said first side wall, said second side wall having an insulating portion formed thereon, said second contact end of said second electric contact terminal extending through said insulating portion along the axis into said accommodation chamber.

5. The vibration switch of claim 4, wherein said first anchoring end is electrically connected to said first contact end of said first electric contact terminal, said deflecting segment being brought into electric contact with said second contact end of said second electric contact terminal when said housing is jerked out of the stable position.

6. The vibration switch of claim 5, wherein said second contact end of said second electric contact terminal is configured such that said loops at said deflecting segment and said second deflected segment surround said second contact end.

7. The vibration switch of claim 6, wherein said loops at said deflecting segment have an inner diameter which is smaller than that of said loops at said first and second deflected segments.

8. The vibration switch of claim 6, wherein said loops of said coil spring have a uniform inner diameter, said second contact end of said second electric contact terminal having an enlarged contact head which is disposed within said loops at said deflecting segment so as to facilitate contact with said loops when said housing is jerked out of the stable position.

9. The vibration switch of claim 4, wherein said first side wall of said housing has an insulating protrusion which extends towards said second side wall along the axis, said first and second anchoring ends being retainingly sleeved on said insulating protrusion and said second contact end of said second electric contact terminal, respectively.

10. The vibration switch of claim 9, wherein said deflectable electric contact body further includes a weight member which is rollably retained in said loops at said deflecting segment so as to increase the inertial force of said deflecting segment when said housing is jerked out of the stable position.

11. The vibration switch of claim 3, wherein said housing is made from an insulating material, each of said first and second contact ends of said first and second electric contact terminals being a rod which is configured to be surrounded by said loops at a respective one of said first and second deflected segments such that said loops at said first and second deflected segments are brought into electric contact with said first and second contact ends, respectively, when said housing is jerked out of the stable position.

12. The vibration switch of claim 11, wherein said deflectable electric contact body further includes a weight member which is retained in said loops at said deflecting segment so as to increase the inertial force of said deflecting segment when said housing is jerked out of the stable position.

* * * * *